US006278045B1

(12) United States Patent
Reyes

(10) Patent No.: US 6,278,045 B1
(45) Date of Patent: Aug. 21, 2001

(54) DRUM LUG PROTECTIVE COVER

(75) Inventor: Gerardo Jose Reyes, Valencia, CA (US)

(73) Assignee: Remo, Inc., Valencia, CA (US)

( * ) Notice: Subject to any disclaimer, the term of this patent is extended or adjusted under 35 U.S.C. 154(b) by 0 days.

(21) Appl. No.: 09/790,580

(22) Filed: Feb. 23, 2001

(51) Int. Cl.[7] ..... G10D 13/02
(52) U.S. Cl. ..... 84/411 R; 84/422.1
(58) Field of Search ..... 84/411 R, 422.1; D17/99, 22

(56) References Cited

U.S. PATENT DOCUMENTS

| | | | | |
|---|---|---|---|---|
| 4,283,985 | * | 8/1981 | Famularo | 84/411 R |
| 5,025,697 | * | 6/1991 | May | 84/411 R |
| 5,546,841 | * | 8/1996 | Chen | 84/411 R |
| 5,952,594 | * | 9/1999 | Chuang | 84/413 |
| 6,018,116 | * | 1/2000 | Simons et al. | 84/411 R |

FOREIGN PATENT DOCUMENTS

| | | | | |
|---|---|---|---|---|
| 913631 | * | 2/1959 | (GB) | 84/411 R |

OTHER PUBLICATIONS

Camco Catalog pp. 1 and 13, Dec. 1964.*

* cited by examiner

*Primary Examiner*—Robert E. Nappi
*Assistant Examiner*—Kim Lockett
(74) *Attorney, Agent, or Firm*—Rapkin & Gitlin; Larry F. Gitlin, Esq.

(57) ABSTRACT

A device comprising a generally cylindrical shaped resilient cover with openings at opposite ends to receive in slidable relation the elongated rod component of a drum lug nut assembly. A slit is provided in combination with one of the openings to enable that end of the cover to expand and connect with the portion of the rod extending either below or above the nut component, as the situation requires. A portion of the back section of the cover is open to enable the cover to easily fit over and around the nut and the other components of the drum lug nut assembly that protrude beyond the surface of the drumshell.

12 Claims, 3 Drawing Sheets

DRUM LUG PROTECTIVE COVER

BACKGROUND OF THE INVENTION

1. Field of the Invention

The present invention relates generally to the field of musical instruments, and more particularly to a cover for drum lugs and their constituent parts for protection against damage to the drum shells of congas or similar kinds of drums when the drums are adjacently situated.

2. Description of the Prior Art

In the past, protective covers have been created for variety of hard or sharp-edged objects, such as, for example, metal nuts and bolts, capable of damaging adjacently situated products. Some of these devices have even been developed specifically for the drum lug components of a conga drum. U.S. Pat. No. 6,018,116 ('116 patent) discloses such a device. In the '116 patent, a device is provided to engage the lug component to prevent damaging contact with another drum. U.S. Pat. No. 5,857,818 discloses another type of protective cover or cap for lug nuts of the kind used to mount a wheel on a vehicle.

Neither of these devices, however, nor anything else known in the prior art addresses the serious problem addressed and corrected by the device of the present invention. The invention achieves this by covering not only the nut and bolt components of the lug nut assembly, but also the various other components of the assembly that protrude beyond the periphery of the conga shell and present conditions that are capable of causing serious and extensive damage to an adjacent instrument.

SUMMARY OF THE INVENTION

The present invention provides a device comprising a generally cylindrical shaped resilient cover with openings at opposite ends to receive in slidable relation the elongated rod component of a drum lug nut assembly. A slit is provided in combination with one of the openings to enable that end of the cover to expand and connect with the portion of the rod extending either below or above the nut component, as the situation dictates. A portion of the back section of the cover is open to enable the cover to easily fit over and around the nut and the other components of the drum lug nut assembly that protrude beyond the surface of the drumshell.

Accordingly, an object of the present invention is to provide a protective cover for a conga drum lug nut assembly that covers and secures all the assembly components that protrude beyond the shell's surface.

Another object of the present invention is to provide a protective cover for a conga drum lug nut assembly that prevents the assembly components, or any of them, that protrude beyond the shell's surface from contacting and damaging the shell of adjacently situated drums.

Still, another object of the present invention is to provide a protective cover for a conga drum lug nut assembly that is easy to install and secure.

Still yet another object of the present invention is to provide a protective cover for a drum lug nut assembly that is easy and cost effective to manufacture.

Other objects and advantages of the present invention will become apparent in the following specifications when considered in light of the attached drawings wherein a preferred embodiment of the invention is illustrated.

DETAILED DESCRIPTION OF THE PREFERRED EMBODIMENT

Figure 1:
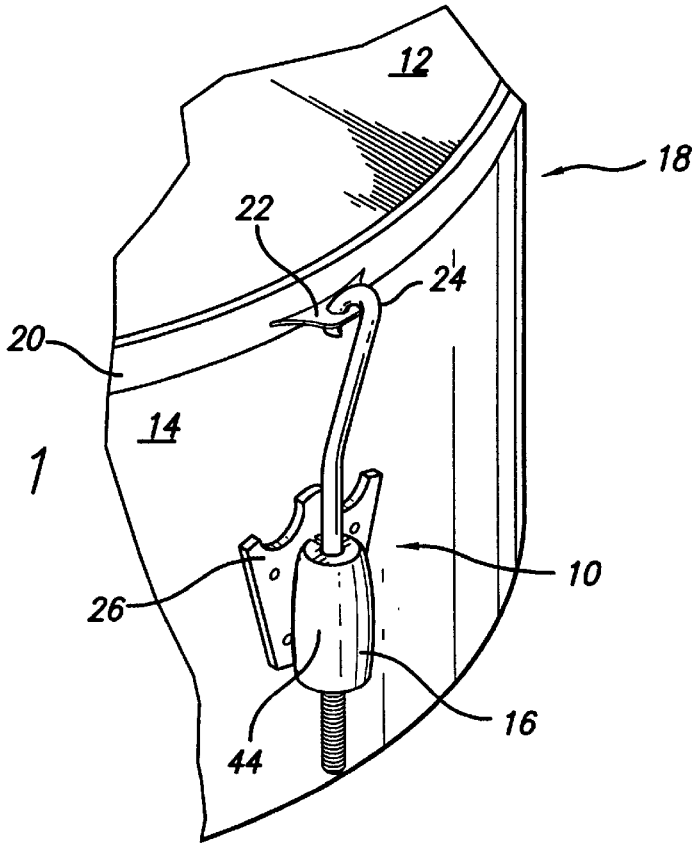
FIG. 1 is a perspective view of the device of the present invention shown enveloping components of a drum lug assembly affixed to a drumshell.
Figure 2:
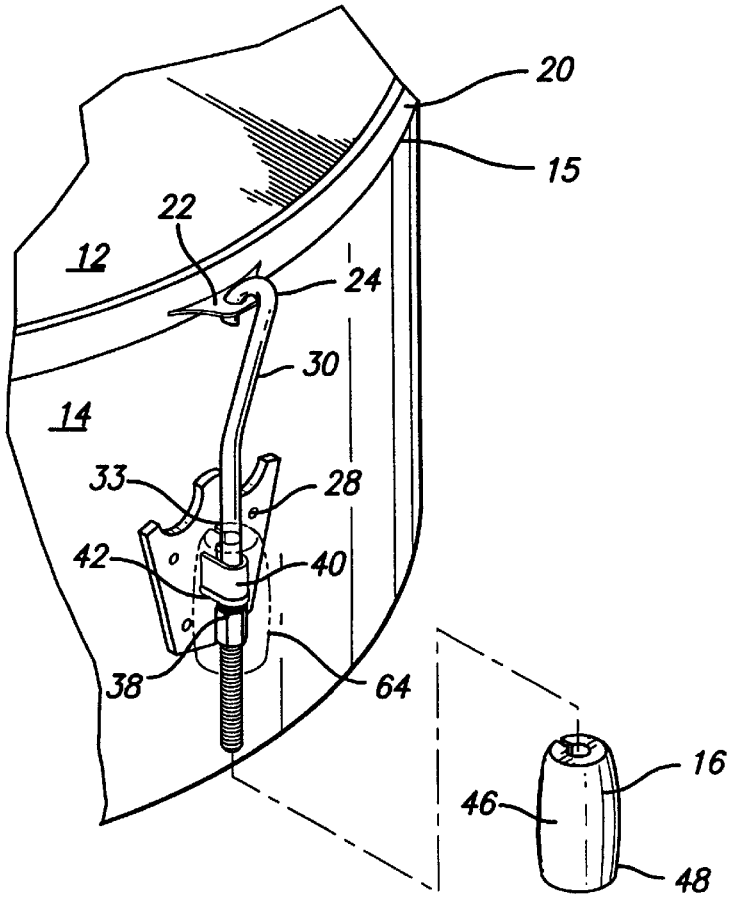
FIG. 2 is a perspective view of the device of the present invention shown in phantom lines in the same context as in FIG. 1.
Figure 3:
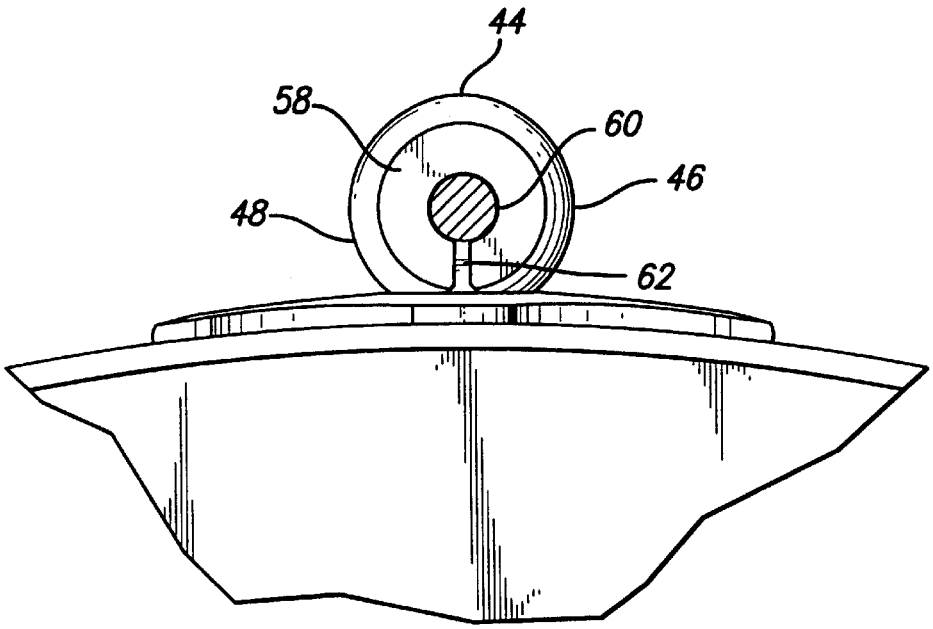
FIG. 3 is a top plan view of the device of the present invention.
Figure 4:
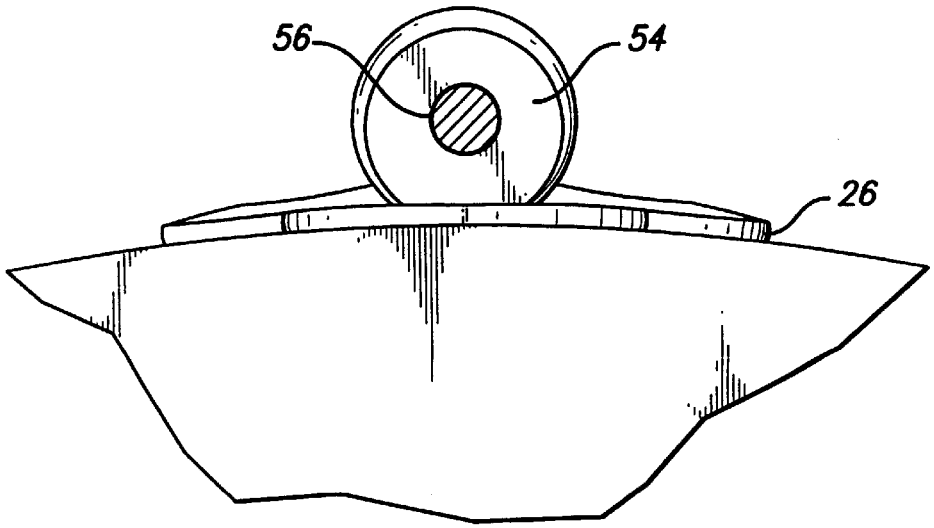
FIG. 4 is a bottom plan view of the device of the present invention.
Figure 5:
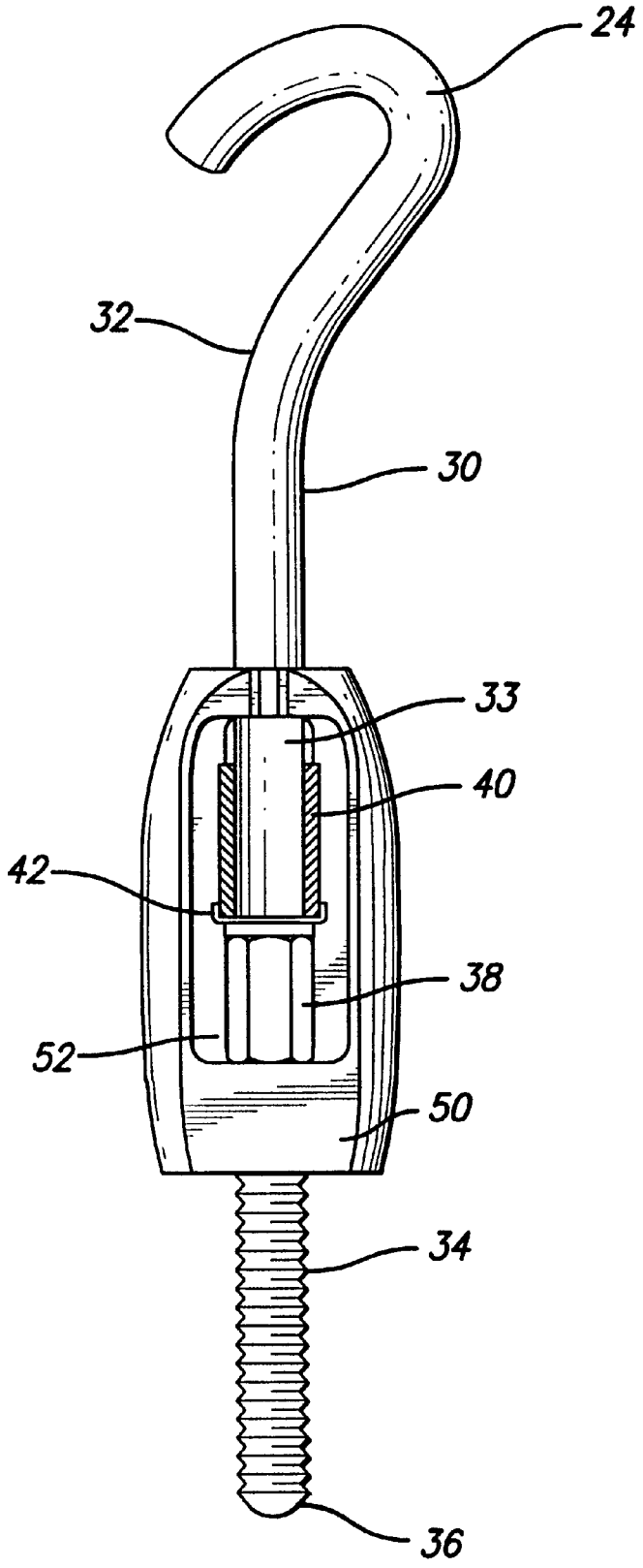
FIG. 5 is a rear elevational view of the device of the present invention shown enveloping components of the drum lug assembly.

Referring now to the figures of the drawing and particularly to FIG. 1, which are offered for the purpose of illustrating the present preferred embodiment of the invention only and not for the purpose of limiting same, a drum lug assembly 10 employed in connection with a drumhead 12 and a drumshell 14 is provided with a drum lug cover 16 for protecting adjacently positioned musical drums 18. Drumshell 14 includes a hoop 20 and a circumventing edge 15. Hoop 20 includes a plurality of bracketed eyelets 22 for engaging corresponding hook-shaped members 24.

Mounting plate 26 is employed to attach drum lug assembly to drumshell 14, and is secured by a plurality of screws 28. Drum lug assembly 10 includes a rod member 30 having an upper end section 32 with hook-shaped member 24 integrally formed therewith, a lower section 34 with a threaded end portion 36, a middle section 33, a nut 38 and a mounting sleeve 40 with a washer 42. Though not essential as an integrally formed component, the preferred embodiment of the present invention provides a mounting sleeve 40 that is integrally formed with mounting plate 26. Drum lug cover 16, which is composed of any suitably resilient material, is generally cylindrical in shape (though it could assume a variety of other shapes) with an arcuate front section 44, integrally formed arcuate side sections 46 and 48 and a generally flat back section 50 with an opening 52 therein conformed in size and shape to receive and envelop significant portions of drum lug assembly 10. Drum lug cover 16 also includes a first end wall 54 with an opening 56 formed therein and a second end wall 58 with an integrally formed opening 60 and slit opening 62.

Drum lug assembly 10 is comprised of components usually of a metal composition, which, when in close physical proximity to a conga or any similar kind of drum, tend to scratch and, in some cases, seriously damage an adjacent shell. In order to prevent damage, drum lug cover 16 is secured to drum lug assembly 10 to ensure that a certain group of the lug assembly components 64, which constitute the components of the assembly that are most likely to cause damage, are shielded from any direct contact with the shell of another instrument.

The device of the present invention can be employed in several ways. One application, wherein drum lug assembly 10 is already intact and secured to drumshell 14, provides that drum lug cover 16 be fitted over components 64 by first inserting the threaded end portion 36 of rod member 30 through opening 56 of drum lug cover 16 and forcing drum lug cover 16 upward so that integrally formed opening 60 and slit opening 62 extend beyond the position of mounting sleeve 40. Slit opening 62 is then caused to engage middle section 33 of rod member 30 forcing middle section 33 through slit opening 62 until the rod is seated securely within opening 60. At the same time, drum lug cover 16, particularly opening 52, is manipulated over components 64 to completely envelop them and create an appropriate protective buffer.

When necessary to remove drum lug cover 16 to gain access to components 64 to enable, for example, the tightening of drum lug assembly 10 or the repair or replacement of a particular component, drum lug cover 16 is simply separated from rod member 30 at the point of the slit opening 62 and then pushed down and away from the position of the assembly components.

Another application of the device of the present invention involves first inserting end portion 36 of rod member 30 through opening 56 of the drum lug cover 16. Hook-shaped member 24 is then caused to engage the corresponding bracketed eyelet 22. Rod member 30 is inserted through mounting sleeve 40 and washer 42, and is secured by nut 38. Drum lug cover 16 is manipulated so that opening 52 is in general alignment with the position of components 64. Second end wall 58 is then extended beyond the position of nut 38, and slit opening 62 is caused to engage lower section 34 of rod member to force section 34 through slit opening 62 to seat the rod section securely within opening 60.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

What is claimed is:

1. In combination with a drum lug assembly for protecting a plurality of adjacently positioned musical drums employed in connection with a drumhead and a drumshell, said drum lug assembly including a rod member having an upper end portion and a lower end portion, a nut and a mounting sleeve, a drum lug cover comprising:

a generally cylinder shaped housing member having arcuate front and side sections and a generally flat back section, said back section having an opening conformed to receive said drum lug assembly, a first end portion defining an aperture and a second end portion defining an aperture for slidably receiving said bolt, said first end portion having a slit opening to enable said first end portion and said aperture lug and first end portion to expand and envelop the lower end portion of said bolt to secure said cover over the drum lug assembly.

2. The invention of claim 1 wherein said second end portion includes a wall section which abuts the mounting sleeve.

3. The invention of claim 1 wherein said first end section includes a wall which abuts said nut.

4. The invention of claim 1 wherein said opening in said back section defines a cavity to receive and encase said drum lug assembly.

5. The invention of claim 1 wherein said mounting sleeve is attached to a mounting plate.

6. The invention of claim 5 wherein said mounting plate is attached to a drumshell.

7. The invention of claim 1 comprising a mounting sleeve end cap.

8. The invention of claim 1 wherein said mounting sleeve end cap includes an aperture.

9. The invention of claim 1 wherein said bolt includes a threaded lower section.

10. The invention of claim 1 wherein said lug cover is made of a resilient material.

11. The invention of claim 1 wherein the construction of said generally cylinder shaped housing member is unitary.

12. A device for safeguarding two or more musical drums closely situated, at least one of said musical drums having a drumhead and a drumshell with an external tuning device attached to said drumshell, said tuning device including a tuning rod having a first end and a second end, said first end being connected to the drumhead for adjusting the tension on the drumhead, a receptacle for receiving said second end, and a nut to secure said second end of said tuning rod for adjusting the tension on the drumhead, the device for safeguarding two or more musical drums closely situated comprising:

a resilient housing material, said housing member including a front wall, first and second sidewalls, a back section having an opening, a first end wall with an aperture therein, and a second end wall with an aperture and a slit opening therein, said opening in said back section and said slit opening being expandable to receive and cover said receptacle and said nut to guard against damaging contact between said drums.

* * * * *